US008931660B2

(12) United States Patent
Stodd et al.

(10) Patent No.: US 8,931,660 B2
(45) Date of Patent: Jan. 13, 2015

(54) CAN SHELL AND DOUBLE-SEAMED CAN END

(71) Applicant: Ball Corporation, Broomfield, CO (US)

(72) Inventors: R. Peter Stodd, Vandalia, OH (US); Jess N. Bathurst, Wheatfield, IN (US)

(73) Assignees: Ball Corporation, Broomfield, CO (US); Container Development, Ltd., Dayton, OH (US)

( * ) Notice: Subject to any disclaimer, the term of this patent is extended or adjusted under 35 U.S.C. 154(b) by 0 days.

(21) Appl. No.: 13/682,260

(22) Filed: Nov. 20, 2012

(65) Prior Publication Data

US 2013/0175280 A1 Jul. 11, 2013

Related U.S. Application Data

(63) Continuation of application No. 12/904,532, filed on Oct. 14, 2010, now Pat. No. 8,313,004, which is a continuation of application No. 10/936,834, filed on Sep. 9, 2004, now Pat. No. 7,819,275, which is a continuation-in-part of application No. 10/361,245, filed on Feb. 10, 2003, now abandoned, which is a continuation-in-part of application No. 10/078,152, filed on Feb. 19, 2002, now Pat. No. 6,516,968, which is a continuation-in-part of application No. 09/898,802, filed on Jul. 3, 2001, now Pat. No. 6,419,110.

(51) Int. Cl.
*B21D 51/44* (2006.01)

(52) U.S. Cl.
USPC ..... 220/619; 220/623

(58) Field of Classification Search
USPC ..... 220/619, 623, 615; 413/8
See application file for complete search history.

(56) References Cited

U.S. PATENT DOCUMENTS 91,754 A 6/1869 Lawrence
163,747 A 5/1875 Cummings
(Continued)

FOREIGN PATENT DOCUMENTS

CH 327383 1/1958
DE 734942 5/1943
(Continued)

OTHER PUBLICATIONS

"Brewing Industry Recommended Can Specifications Manual", United States Brewers Assoc., Inc, May 1983, pp. 1-7.
(Continued)

*Primary Examiner* — Stephen Castellano
(74) *Attorney, Agent, or Firm* — Sheridan Ross P.C.

(57) ABSTRACT

A drawn aluminum can shell has a peripheral crown which is double-seamed with an end portion of an aluminum can body to provide a can end having a generally flat center panel connected by an inclined curved or straight panel wall to an inclined inner wall of an annular U-shaped countersink. The countersink has an outer wall which connects with an inclined lower wall portion of a chuck wall at a junction below the center panel, and the chuck wall has a curved or inclined upper wall portion which connects with an inner wall of the crown. The chuck wall also has an intermediate wall portion forming a break, and the inner bottom width of the countersink is less than the radial width of the panel wall. The inclined upper wall portion of the chuck wall extends at an angle greater than the angle of the inclined lower wall portion of the chuck wall.

19 Claims, 6 Drawing Sheets

(56) References Cited

U.S. PATENT DOCUMENTS

| | | | |
|---|---|---|---|
| 706,296 | A | 8/1902 | Bradley |
| 766,604 | A | 8/1904 | Dilg |
| 801,683 | A | 10/1905 | Penfold |
| 818,438 | A | 4/1906 | Heindorf |
| 868,916 | A | 10/1907 | Dieckmann |
| 1,045,055 | A | 11/1912 | Mittinger, Jr. |
| 1,957,639 | A | 6/1932 | Goodwin |
| 2,027,430 | A | 1/1936 | Hilmer |
| 2,060,145 | A | 11/1936 | Vogel |
| 2,119,533 | A | 6/1938 | Fink |
| 2,318,603 | A | 5/1943 | Erb |
| D141,415 | S | 5/1945 | Wargel et al. |
| 2,759,628 | A | 8/1956 | Sokoloff |
| 2,819,006 | A | 1/1958 | Magill et al. |
| 2,894,844 | A | 7/1959 | Shakman |
| 3,023,927 | A | 3/1962 | Ehman |
| 3,025,814 | A | 3/1962 | Currie et al. |
| 3,057,537 | A | 10/1962 | Pollick |
| 3,105,765 | A | 10/1963 | Creegan |
| 3,176,872 | A | 4/1965 | Zundel |
| 3,208,627 | A | 9/1965 | Lipske |
| 3,251,515 | A | 5/1966 | Henchert et al. |
| 3,268,105 | A | 8/1966 | Geiger |
| D206,500 | S | 12/1966 | Nissen et al. |
| 3,383,748 | A | 5/1968 | Galimberti et al. |
| 3,397,811 | A | 8/1968 | Lipske |
| 3,417,898 | A | 12/1968 | Bozek et al. |
| 3,480,175 | A | 11/1969 | Khoury |
| 3,525,455 | A | 8/1970 | Saunders |
| 3,564,895 | A | 2/1971 | Pfanner et al. |
| 3,650,387 | A | 3/1972 | Hornsby et al. |
| 3,715,054 | A | 2/1973 | Gedde |
| 3,734,338 | A | 5/1973 | Schubert |
| 3,744,667 | A | 7/1973 | Fraze et al. |
| 3,745,623 | A | 7/1973 | Wentorf, Jr. et al. |
| 3,757,716 | A | 9/1973 | Gedde |
| 3,762,005 | A | 10/1973 | Erkfritz |
| 3,765,352 | A | 10/1973 | Schubert et al. |
| D229,396 | S | 11/1973 | Zundel |
| 3,774,801 | A | 11/1973 | Gedde |
| 3,814,279 | A | 6/1974 | Rayzal |
| 3,836,038 | A | 9/1974 | Cudzik |
| 3,843,014 | A | 10/1974 | Cospen et al. |
| 3,868,919 | A | 3/1975 | Schrecker et al. |
| 3,871,314 | A | 3/1975 | Stargell |
| 3,874,553 | A | 4/1975 | Schultz et al. |
| 3,904,069 | A | 9/1975 | Toukmanian |
| 3,907,152 | A | 9/1975 | Wessely |
| 3,967,752 | A | 7/1976 | Cudzik |
| 3,982,657 | A | 9/1976 | Keller et al. |
| 3,983,827 | A | 10/1976 | Meadors |
| 4,015,744 | A | 4/1977 | Brown |
| 4,024,981 | A | 5/1977 | Brown |
| 4,030,631 | A | 6/1977 | Brown |
| 4,031,837 | A | 6/1977 | Jordan |
| 4,037,550 | A | 7/1977 | Zofko |
| 4,043,168 | A | 8/1977 | Mazurek |
| 4,056,871 | A | 11/1977 | Bator |
| 4,087,193 | A | 5/1978 | Mundy |
| 4,093,102 | A | 6/1978 | Kraska |
| 4,109,599 | A | 8/1978 | Schultz |
| 4,116,361 | A | 9/1978 | Stargell |
| 4,120,419 | A | 10/1978 | Saunders |
| 4,126,652 | A | 11/1978 | Oohara et al. |
| 4,127,212 | A | 11/1978 | Waterbury |
| 4,148,410 | A | 4/1979 | Brown |
| 4,150,765 | A | 4/1979 | Mazurek |
| 4,210,257 | A | 7/1980 | Radtke |
| 4,213,324 | A | 7/1980 | Kelley et al. |
| 4,215,795 | A | 8/1980 | Elser |
| 4,217,843 | A | 8/1980 | Kraska |
| 4,264,017 | A | 4/1981 | Karas et al. |
| 4,271,778 | A | 6/1981 | Le Bret |
| 4,274,351 | A | 6/1981 | Boardman |
| 4,276,993 | A | 7/1981 | Hasegawa |
| 4,286,728 | A | 9/1981 | Fraze et al. |
| 4,341,321 | A | 7/1982 | Gombas |
| 4,365,499 | A | 12/1982 | Hirota et al. |
| 4,387,827 | A | 6/1983 | Ruemer, Jr. |
| 4,402,419 | A | 9/1983 | MacPherson |
| 4,420,283 | A | 12/1983 | Post |
| 4,434,641 | A | 3/1984 | Nguyen |
| 4,435,969 | A | 3/1984 | Nichols et al. |
| 4,448,322 | A | 5/1984 | Kraska |
| 4,467,933 | A | 8/1984 | Wilkinson et al. |
| 4,516,420 | A | 5/1985 | Bulso et al. |
| D279,265 | S | 6/1985 | Turner et al. |
| 4,530,631 | A | 7/1985 | Kaminski et al. |
| D281,581 | S | 12/1985 | MacEwen |
| 4,559,801 | A | 12/1985 | Smith et al. |
| 4,563,887 | A | 1/1986 | Bressan et al. |
| 4,571,978 | A | 2/1986 | Taube et al. |
| 4,577,774 | A | 3/1986 | Nguyen |
| 4,578,007 | A | 3/1986 | Diekhoff |
| 4,587,825 | A | 5/1986 | Bulso et al. |
| 4,587,826 | A | 5/1986 | Bulso et al. |
| 4,606,472 | A | 8/1986 | Taube et al. |
| D285,661 | S | 9/1986 | Brown |
| 4,641,761 | A | 2/1987 | Smith et al. |
| 4,674,649 | A | 6/1987 | Pavely |
| 4,681,238 | A | 7/1987 | Sanchez |
| 4,685,582 | A | 8/1987 | Pulciani et al. |
| 4,685,849 | A | 8/1987 | Labarge et al. |
| 4,697,972 | A | 10/1987 | Le Bret et al. |
| 4,704,887 | A | 11/1987 | Bachmann et al. |
| 4,713,958 | A | 12/1987 | Bulso, Jr. et al. |
| 4,715,208 | A | 12/1987 | Bulso, Jr. et al. |
| 4,716,755 | A | 1/1988 | Bulso, Jr. et al. |
| 4,722,215 | A | 2/1988 | Taube et al. |
| 4,735,863 | A | 4/1988 | Bachmann et al. |
| 4,781,047 | A | 11/1988 | Bressan et al. |
| 4,790,705 | A | 12/1988 | Wilkinson et al. |
| 4,796,772 | A | 1/1989 | Nguyen |
| 4,804,106 | A | 2/1989 | Saunders |
| 4,808,052 | A | 2/1989 | Bulso, Jr. et al. |
| 4,809,861 | A | 3/1989 | Wilkinson |
| D300,607 | S | 4/1989 | Ball |
| D300,608 | S | 4/1989 | Taylor et al. |
| 4,820,100 | A | 4/1989 | Riviere |
| 4,823,973 | A | 4/1989 | Jewitt et al. |
| 4,832,223 | A | 5/1989 | Kalenak et al. |
| 4,832,236 | A | 5/1989 | Greaves |
| 4,865,506 | A | 9/1989 | Kaminski |
| D304,302 | S | 10/1989 | Dalli et al. |
| 4,885,924 | A | 12/1989 | Claydon et al. |
| 4,890,759 | A | 1/1990 | Scanga et al. |
| 4,893,725 | A | 1/1990 | Ball et al. |
| 4,895,012 | A | 1/1990 | Cook et al. |
| 4,919,294 | A | 4/1990 | Kawamoto |
| RE33,217 | E | 5/1990 | Nguyen |
| 4,930,658 | A | 6/1990 | McEldowney |
| 4,934,168 | A | 6/1990 | Osmanski et al. |
| 4,955,223 | A | 9/1990 | Stodd et al. |
| 4,967,538 | A | 11/1990 | Leftault, Jr. et al. |
| 4,991,735 | A | 2/1991 | Biondich |
| 4,994,009 | A | 2/1991 | McEldowney |
| 4,995,223 | A | 2/1991 | Spatafora et al. |
| 5,016,463 | A | 5/1991 | Johansson et al. |
| 5,026,960 | A | 6/1991 | Slutz et al. |
| 5,027,580 | A | 7/1991 | Hymes et al. |
| 5,042,284 | A | 8/1991 | Stodd et al. |
| 5,046,637 | A | 9/1991 | Kysh |
| 5,064,087 | A | 11/1991 | Koch |
| 5,066,184 | A | 11/1991 | Taura et al. |
| 5,069,355 | A | 12/1991 | Matuszak |
| 5,105,977 | A | 4/1992 | Taniuchi |
| 5,129,541 | A | 7/1992 | Voigt et al. |
| 5,141,367 | A | 8/1992 | Beeghly et al. |
| 5,143,504 | A | 9/1992 | Braakman |
| 5,145,086 | A | 9/1992 | Krause |
| 5,149,238 | A | 9/1992 | McEldowney et al. |
| 5,174,706 | A | 12/1992 | Taniuchi |
| 5,222,385 | A | 6/1993 | Halasz et al. |
| D337,521 | S | 7/1993 | McNulty |

(56) References Cited

U.S. PATENT DOCUMENTS

| | | | |
|---|---|---|---|
| 5,245,848 | A | 9/1993 | Lee, Jr. et al. |
| 5,289,938 | A | 3/1994 | Sanchez |
| D347,172 | S | 5/1994 | Heynan et al. |
| 5,309,749 | A | 5/1994 | Stodd |
| 5,320,469 | A | 6/1994 | Katou et al. |
| 5,325,696 | A | 7/1994 | Jentzsch et al. |
| 5,349,837 | A | 9/1994 | Halasz et al. |
| 5,355,709 | A | 10/1994 | Bauder et al. |
| 5,356,256 | A | 10/1994 | Turner et al. |
| D352,898 | S | 11/1994 | Vacher |
| 5,381,683 | A | 1/1995 | Cowling |
| D356,498 | S | 3/1995 | Strawser |
| 5,465,599 | A | 11/1995 | Lee, Jr. |
| 5,494,184 | A | 2/1996 | Noguchi et al. |
| 5,502,995 | A | 4/1996 | Stodd |
| 5,524,468 | A | 6/1996 | Jentzsch et al. |
| 5,527,143 | A | 6/1996 | Turner et al. |
| 5,540,352 | A | 7/1996 | Halasz et al. |
| 5,555,992 | A | 9/1996 | Sedgeley |
| 5,563,107 | A | 10/1996 | Dubensky et al. |
| 5,582,319 | A | 12/1996 | Heyes et al. |
| 5,590,807 | A | 1/1997 | Forrest et al. |
| 5,598,734 | A | 2/1997 | Forrest et al. |
| 5,612,264 | A | 3/1997 | Nilsson et al. |
| 5,634,366 | A | 6/1997 | Stodd |
| 5,636,761 | A | 6/1997 | Diamond et al. |
| 5,653,355 | A | 8/1997 | Tominaga et al. |
| 5,676,512 | A | 10/1997 | Diamond et al. |
| 5,685,189 | A | 11/1997 | Nguyen et al. |
| 5,697,242 | A | 12/1997 | Halasz et al. |
| 5,706,686 | A | 1/1998 | Babbitt et al. |
| 5,749,488 | A | 5/1998 | Bagwell et al. |
| 5,823,730 | A | 10/1998 | La Rovere |
| 5,829,623 | A | 11/1998 | Otsuka et al. |
| 5,857,374 | A | 1/1999 | Stodd |
| D406,236 | S | 3/1999 | Brifcani et al. |
| 5,911,551 | A | 6/1999 | Moran |
| 5,934,127 | A | 8/1999 | Ihly |
| 5,950,858 | A | 9/1999 | Sergeant |
| 5,957,647 | A | 9/1999 | Hinton |
| 5,969,605 | A | 10/1999 | McIntyre et al. |
| 5,971,259 | A | 10/1999 | Bacon |
| 6,024,239 | A | 2/2000 | Turner et al. |
| 6,033,789 | A | 3/2000 | Saveker et al. |
| 6,055,836 | A | 5/2000 | Waterworth et al. |
| 6,058,753 | A | 5/2000 | Jowitt et al. |
| 6,065,634 | A | 5/2000 | Brifcani et al. |
| 6,089,072 | A | 7/2000 | Fields |
| 6,102,243 | A | 8/2000 | Fields et al. |
| 6,126,034 | A | 10/2000 | Borden et al. |
| 6,131,761 | A | 10/2000 | Cheng et al. |
| 6,234,337 | B1 | 5/2001 | Huber et al. |
| 6,290,447 | B1 | 9/2001 | Siemonsen et al. |
| 6,296,139 | B1 | 10/2001 | Hanafusa et al. |
| D452,155 | S | 12/2001 | Stodd |
| 6,386,013 | B1 | 5/2002 | Werth |
| 6,408,498 | B1 | 6/2002 | Fields et al. |
| 6,419,110 | B1 | 7/2002 | Stodd |
| 6,425,493 | B1 | 7/2002 | Gardiner |
| 6,425,721 | B1 | 7/2002 | Zysset |
| 6,428,261 | B1 | 8/2002 | Zysset |
| 6,460,723 | B2 | 10/2002 | Nguyen et al. |
| 6,499,622 | B1 | 12/2002 | Neiner |
| 6,516,968 | B2 | 2/2003 | Stodd |
| 6,526,799 | B2 | 3/2003 | Ferraro et al. |
| 6,561,004 | B1 | 5/2003 | Neiner et al. |
| 6,616,393 | B1 | 9/2003 | Jentzsch |
| D480,304 | S | 10/2003 | Stodd |
| 6,634,837 | B1 | 10/2003 | Anderson |
| 6,658,911 | B2 | 12/2003 | McClung |
| 6,702,142 | B2 | 3/2004 | Neiner |
| 6,702,538 | B1 | 3/2004 | Heinicke et al. |
| 6,736,283 | B1 | 5/2004 | Santamaria et al. |
| 6,748,789 | B2 | 6/2004 | Turner et al. |
| 6,761,280 | B2 | 7/2004 | Zonker et al. |
| 6,772,900 | B2 | 8/2004 | Turner et al. |
| 6,817,819 | B2 | 11/2004 | Olson et al. |
| 6,837,089 | B2 | 1/2005 | Jentzsch et al. |
| 6,848,875 | B2 | 2/2005 | Brifcani et al. |
| 6,877,941 | B2 | 4/2005 | Brifcani et al. |
| 6,915,553 | B2 | 7/2005 | Turner et al. |
| 6,935,826 | B2 | 8/2005 | Brifcani et al. |
| 6,959,577 | B2 | 11/2005 | Jentzsch |
| 6,968,724 | B2 | 11/2005 | Hubball |
| 7,004,345 | B2 | 2/2006 | Turner et al. |
| 7,100,789 | B2 | 9/2006 | Nguyen et al. |
| 7,125,214 | B2 | 10/2006 | Carrein et al. |
| 7,174,762 | B2 | 2/2007 | Turner et al. |
| 7,263,868 | B2 | 9/2007 | Jentzsch et al. |
| 7,341,163 | B2 | 3/2008 | Stodd |
| 7,350,392 | B2 | 4/2008 | Turner et al. |
| 7,370,774 | B2 | 5/2008 | Watson et al. |
| 7,380,684 | B2 | 6/2008 | Reed et al. |
| 7,500,376 | B2 | 3/2009 | Bathurst et al. |
| 7,506,779 | B2 | 3/2009 | Jentzsch et al. |
| 7,591,392 | B2 | 9/2009 | Watson et al. |
| 7,673,768 | B2 | 3/2010 | Reed et al. |
| 7,743,635 | B2 | 6/2010 | Jentzsch et al. |
| 7,819,275 | B2 | 10/2010 | Stodd |
| 7,938,290 | B2 | 5/2011 | Bulso |
| 8,205,477 | B2 | 6/2012 | Jentzsch et al. |
| 8,235,244 | B2 | 8/2012 | Bulso |
| 8,313,004 | B2 | 11/2012 | Stodd et al. |
| 2001/0037668 | A1 | 11/2001 | Fields |
| 2002/0139805 | A1 | 10/2002 | Chasteen et al. |
| 2002/0158071 | A1 | 10/2002 | Chasteen et al. |
| 2003/0121924 | A1 | 7/2003 | Stodd |
| 2003/0177803 | A1 | 9/2003 | Golding et al. |
| 2003/0198538 | A1 | 10/2003 | Brifcani et al. |
| 2004/0026433 | A1 | 2/2004 | Brifcani et al. |
| 2004/0026434 | A1 | 2/2004 | Brifcani et al. |
| 2004/0052593 | A1 | 3/2004 | Anderson |
| 2004/0140312 | A1 | 7/2004 | Neiner |
| 2004/0238546 | A1 | 12/2004 | Watson et al. |
| 2005/0247717 | A1 | 11/2005 | Brifcani et al. |
| 2005/0252922 | A1 | 11/2005 | Reed et al. |
| 2006/0010957 | A1 | 1/2006 | Hubball |
| 2006/0071005 | A1 | 4/2006 | Bulso |
| 2012/0292329 | A1 | 11/2012 | Bulso |

FOREIGN PATENT DOCUMENTS

| | | |
|---|---|---|
| DE | 9211788 | 1/1993 |
| EP | 0049020 | 4/1982 |
| EP | 0139282 | 5/1985 |
| EP | 0153115 | 8/1985 |
| EP | 0340955 | 11/1989 |
| EP | 0348070 | 12/1989 |
| EP | 0482581 | 4/1992 |
| EP | 0828663 | 12/1999 |
| EP | 1361164 | 11/2003 |
| FR | 917771 | 1/1947 |
| GB | 767029 | 1/1957 |
| GB | 2196891 | 5/1988 |
| GB | 2218024 | 11/1989 |
| GB | 2315478 | 2/1998 |
| JP | 49-096887 | 9/1974 |
| JP | 50-144580 | 11/1975 |
| JP | 54-074184 | 6/1979 |
| JP | 55-122945 | 9/1980 |
| JP | 56-032227 | 4/1981 |
| JP | 56-53835 | 5/1981 |
| JP | 56-53836 | 5/1981 |
| JP | 56-107323 | 8/1981 |
| JP | 57-44435 | 3/1982 |
| JP | 57-94436 | 6/1982 |
| JP | 57-117323 | 7/1982 |
| JP | 58-035028 | 3/1983 |
| JP | 58-35029 | 3/1983 |
| JP | 59-144535 | 8/1984 |
| JP | 61-023533 | 2/1986 |
| JP | S61-115834 | 6/1986 |
| JP | 63-125152 | 5/1988 |
| JP | 01-167050 | 6/1989 |

(56) References Cited

FOREIGN PATENT DOCUMENTS

| | | |
|---|---|---|
| JP | 01-170538 | 7/1989 |
| JP | 01-289526 | 11/1989 |
| JP | H02-11033 | 1/1990 |
| JP | 02-092426 | 4/1990 |
| JP | 02-131931 | 5/1990 |
| JP | 02-192837 | 7/1990 |
| JP | 03-032835 | 2/1991 |
| JP | 03-275223 | 12/1991 |
| JP | 03-275443 | 12/1991 |
| JP | 04-033733 | 2/1992 |
| JP | 04-055028 | 2/1992 |
| JP | 05-32255 | 2/1993 |
| JP | 05-112357 | 5/1993 |
| JP | 05-185170 | 7/1993 |
| JP | 06-127547 | 5/1994 |
| JP | 06-179445 | 6/1994 |
| JP | 07-171645 | 7/1995 |
| JP | 08-168837 | 7/1996 |
| JP | 08-192840 | 7/1996 |
| JP | 2000-109068 | 4/2000 |
| JP | 2001-314931 | 11/2001 |
| JP | 2001-328663 | 11/2001 |
| JP | 2001-334332 | 12/2001 |
| JP | 2002-239662 | 8/2002 |
| WO | WO 83/02577 | 8/1983 |
| WO | WO 89/10216 | 11/1989 |
| WO | WO 93/01903 | 2/1993 |
| WO | WO 93/17864 | 9/1993 |
| WO | WO 96/37414 | 11/1996 |
| WO | WO 98/34743 | 8/1998 |
| WO | WO 00/12243 | 3/2000 |
| WO | WO 00/64609 | 11/2000 |
| WO | WO 01/41948 | 6/2001 |
| WO | WO 02/43895 | 6/2002 |
| WO | WO 02/068281 | 9/2002 |
| WO | WO 03/059764 | 7/2003 |
| WO | WO 2005/032953 | 4/2005 |
| WO | WO 2007/005564 | 1/2007 |
| WO | WO 2011/053776 | 5/2011 |

OTHER PUBLICATIONS

"Beverage Can, End, & Double Seam Dimensional Specifications", Society of Soft Drink Technologiests, Aug. 1993, pp. 1-6.

"Guideline Booklet of the Society of Soft Drink Technologists", Can and End Committee of the Society of Soft Drink Technologists, Jun. 5, 1986, pp. 1-21.

Official Action for U.S. Appl. No. 12/904,532, mailed Jan. 24, 2012, 8 pages.

Notice of Allowance for U.S. Appl. No. 12/904,532, mailed Jul. 19, 2012, 7 pages.

CAN SHELL AND DOUBLE-SEAMED CAN END

RELATED APPLICATION

This application is a Continuation of U.S. patent application Ser. No. 12/904,532, filed Oct. 14, 2010, now U.S. Pat. No. 8,313,004, which is a Continuation of Ser. No. 10/936,834, filed Sep. 9, 2004, now U.S. Pat. No. 7,819,275, which is a Continuation-In-Part of abandoned U.S. patent application Ser. No. 10/361,245, filed Feb. 10, 2003, which is a Continuation-In-Part of U.S. patent application Ser. No. 10/078,152, filed Feb. 19, 2002, now U.S. Pat. No. 6,516,968, which is a Continuation-In-Part of U.S. patent application Ser. No. 09/898,802, filed Jul. 3, 2001, now U.S. Pat. No. 6,419,110, the entire disclosures of which are incorporated by reference herein.

BACKGROUND OF THE INVENTION

This invention relates to the construction or forming of a sheet metal or aluminum can shell and can end having a peripheral rim or crown which is double-seamed to the upper edge portion of a sheet metal or aluminum can body. Such a can end is formed from a drawn sheet metal can shell, for example, a shell produced by tooling as disclosed in applicant's U.S. Pat. No. 5,857,374 the disclosure of which is herein incorporated by reference. Commonly, the formed can shell includes a circular center panel which extends to a panel wall which extends to or also forms the inner wall of a reinforcing rib or countersink having a U-shaped cross-sectional configuration. The countersink is connected by a generally frusto-conical chuckwall to an annular crown which is formed with a peripheral curl. For beverage containers, the center panel of the shell is commonly provided with an E-Z open tab, and after the can body is filled with a beverage, the peripherally curled crown of the shell is double-seamed to the upper end portion of the can body.

When the can body is filled with a carbonated beverage or a beverage which must be pasteurized at a high temperature, it is essential for the can end to have a substantial buckle strength to withstand the pressurized beverage, for example, a buckle strength of at least 90 psi. Such resistance to "buckle" pressure and "rock" pressure is described in detail in U.S. Pat. No. 4,448,322, the disclosure of which is incorporated by reference. It is also desirable to minimize the weight of sheet metal or aluminum within the can end without reducing the buckle strength. This is accomplished by either reducing the thickness or gage of the flat sheet metal from which the can shell is drawn and formed and/or by reducing the diameter of the circular blank cut from the sheet metal to form the can shell.

There have been many sheet metal shells and can ends constructed or proposed for increasing the buckle strength of the can end and/or reducing the weight of sheet metal within the can end without reducing the buckle strength. For example, U.S. Pat. Nos. 3,843,014, 4,031,837, 4,093,102, above-mentioned U.S. Pat. Nos. 4,448,322, 4,790,705, 4,808,052, 5,046,637, 5,527,143, 5,685,189, 6,065,634, 6,089,072, 6,102,243, 6,460,723 and 6,499,622 disclose various forms and configurations of can shells and can ends and the various dimensions and configurations which have been proposed or used for increasing the buckle strength of a can end and/or reducing the metal in the can end. Also, published PCT application No. WO 98/34743 discloses a modification of the can shell and can end disclosed in above-mentioned U.S. Pat. No. 6,065,634. In addition to increasing the buckle strength/weight ratio of a can end, it is desirable to form the can shell so that there is minimal modifications required to the extensive tooling existing in the field for adding the E-Z open tabs to the can shells and for double-seaming the can shells to the can bodies. While some of the can shells and can ends disclosed in the above patents provide some of desirable structural features, none of the patents provide all of the features.

SUMMARY OF THE INVENTION

The present invention is directed to an improved sheet metal shell and can end and a method of forming the can end which provides the desirable features and advantages mentioned above, including a significant reduction in the blank diameter for forming a can shell and a significant increase in strength/weight ratio of the resulting can end. A can shell and can end formed in accordance with the invention not only increases the buckle strength of the can end but also minimizes the changes or modifications in the existing tooling for adding E-Z open tabs to the can shells and for double-seaming the can shells to the can bodies.

In accordance with one embodiment of the invention, the can shell and can end are formed with an overall height between the crown and the countersink of less than 0.240 inch and preferably less than 0.230 inch, and the countersink has a generally cylindrical outer wall and an inner wall connected to a curved panel wall. A generally frusto-conical chuckwall extends from the outer wall of the countersink to the inner wall of the crown and has an upper wall portion extending at an angle of at least 16° relative to the center axis of the shell, and preferably between 25° and 30°. The countersink may have a generally flat bottom wall or inclined inner wall which connects with the countersink outer wall with a small radius substantially less than the radial width of the bottom wall, and the inside width of the countersink at its bottom is less than the radius of the panel wall.

In accordance with modifications of the invention, a can shell and can end have some of the above structure and with the junction of a lower wall portion of the chuckwall and the outer countersink wall being substantially below the center panel. The lower wall portion of the countersink extends at an angle less than the angle of the upper wall portion relative to the center axis and is connected to the upper wall portion by a short wall portion which provides the chuckwall with a break or kick or a slight S-curved configuration. The countersink has a radius of curvature substantially smaller than the radius of curvature or radial width of the panel wall, and the inner bottom width of the countersink is also less than the radius or radial width of the panel wall, and preferably less than 0.035 inch. In a preferred embodiment, the countersink has an inclined bottom wall portion, and the panel wall has an inclined flat wall portion.

U.S. Pat. No. 7,341,163, which relates to a can shell and double-seamed can end, is hereby incorporated by reference in its entirety.

Other features and advantages of the invention will be apparent from the following description, the accompanying drawings and the appended claims.

DESCRIPTION OF THE PREFERRED EMBODIMENTS

Figure 1:
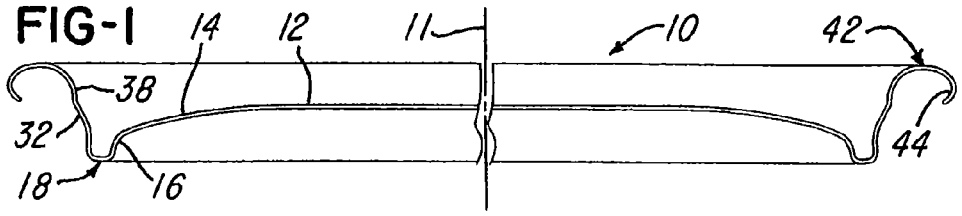
FIG. 1 is a vertical cross-section through a sheet metal can shell formed in accordance with the invention.
Figure 2:
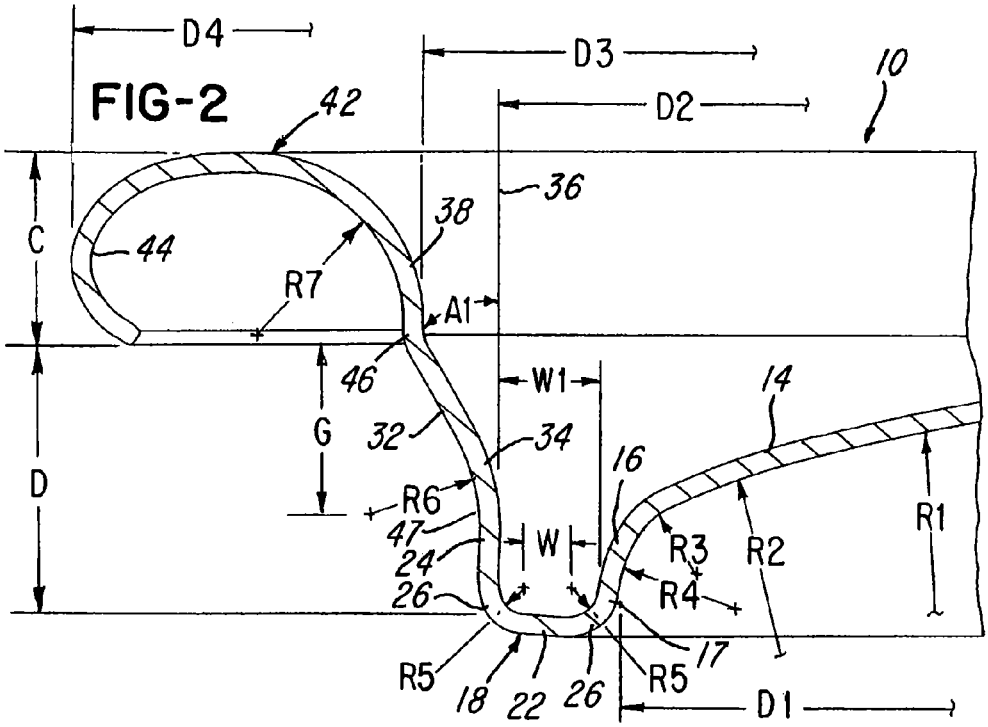
FIG. 2 is an enlarged fragmentary section of the can shell in FIG. 1 and showing the configuration of one embodiment.

FIG. 1 illustrates a one-piece shell 10 which is formed from a substantially circular blank of sheet metal or aluminum, preferably having a thickness of about 0.0085 inch and a blank diameter of about 2.705 inches. The shell 10 has a center axis 11 and includes a slightly crowned center panel 12 with an annular portion 14 extending to a curved panel wall 16. The center panel wall portion 14 and panel wall 16 may be formed by a series of blended curved walls having radii wherein R1 is 1.489 inch, R2 is 0.321 inch, R3 is 0.031 inch, and R4 is 0.055 inch. The curved panel wall 16 has a bottom inner diameter D1 of about 1.855 inch.

The curved panel wall 16 with the radius R4 extends from an inner wall 17 of a reinforcing rib or countersink 18 having a U-shaped cross-sectional configuration and including a flat annular bottom wall 22 and a generally cylindrical outer wall 24 having an inner diameter D2, for example, of about 1.957 inches. The flat bottom wall 22 of the countersink 18 is connected to the inner panel wall 16 and the outer countersink wall 24 by curved corner walls 26 each having an inner radius R5 of about 0.010 inch. The radial width W of the flat bottom wall 22 is preferably about 0.022 inch so that the inner bottom width W1 of the countersink 18 is about 0.042 inch.

The outer wall 24 of the countersink 18 connects with a generally frusto-conical chuckwall 32 by a curved wall 34 having a radius R6 of about 0.054 inch. The chuckwall 32 extends at an angle A1 of at least 16° with respect to the center axis 11 or a vertical reference line 36 which is parallel to the center axis 11 of the shell. Preferably, the angle A1 is between 25° and 30° and on the order of 29°. The upper end of the chuckwall 32 connects with the bottom of a curved inner wall 38 of a rounded crown 42 having a curled outer wall 44. Preferably, the inner wall 38 of the crown 42 has a radius R7 of about 0.070 inch, the inner diameter D3 at the bottom of the curved inner wall 38 is about 2.039 inch, and the outer diameter D4 of the curled outer wall 44 is about 2.340 inches. The height C of the curled outer wall 44 is within the range of 0.075 inch and 0.095 inch and is preferably about 0.079 inch. The depth D from the bottom of the outer curled wall 44 or the junction 46 of the chuckwall 32 and the inner crown wall 38 to the inner surface of the countersink bottom wall 22 is within the range between 0.108 inch and 0.148 inch, and preferably about 0.126 inch. The junction 47 or the center point for the radius R6 has a depth G of about 0.079 from the junction 46 or bottom of the curled outer wall 44 of the crown 42.

Figure 3:
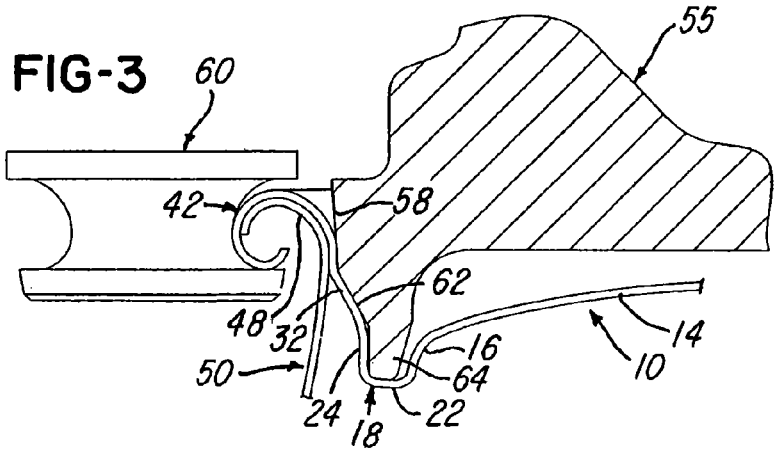
FIG. 3 is a smaller fragmentary section of the can shell of FIG. 2 and showing the can shell becoming a can end with a double-seaming chuck and a first stage roller.

FIG. 3 shows the crown 42 of the shell 10 being double-seamed onto an upper peripheral end portion 48 of a sheet metal or aluminum can body 50. The double-seaming operation is performed between a rotating double-seaming circular chuck 55 which engages the shell 10 and has an outer surface 58 which may be slightly tapered between an angle of 0° and 10° with respect to the center axis of the chuck 55 and the common center axis 11 of the shell 10. Preferably, the surface 58 has a slight taper of about 4° and is engaged by the inner wall 38 of the crown 42 in response to radially inward movement of a first stage double-seaming roller 60 while the can body 50 and its contents and the shell 10 are rotating or spinning with the chuck 55. The chuck 55 also has a frusto-conical surface 62 which mates with and engages the frusto-conical chuckwall 32 of the shell 10, and a downwardly projecting annular lip portion 64 of the chuck 55 extends into the countersink 18 and has a bottom surface 66 (FIG. 5) and a cylindrical outer surface 68 which engage the bottom wall 22 and the outer wall 24 of the countersink 18, respectively.

Figure 4:
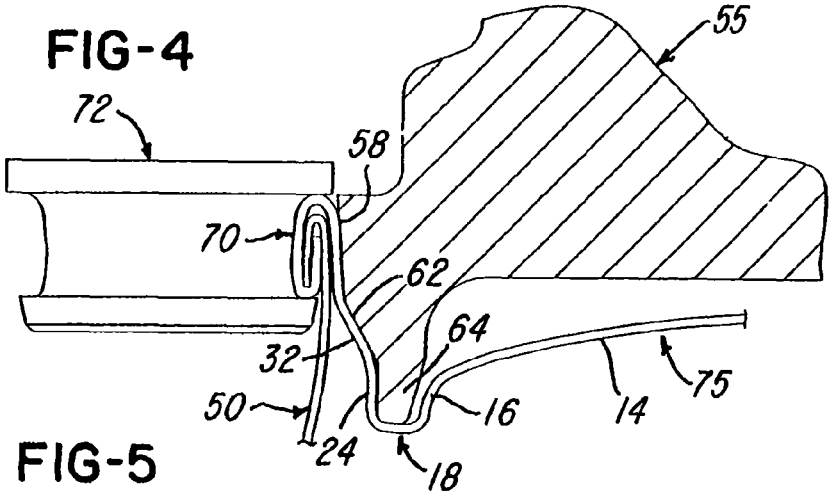
FIG. 4 is a fragmentary section similar to FIG. 3 and showing a double-seamed can end with the chuck and a second stage roller.
Figure 5:
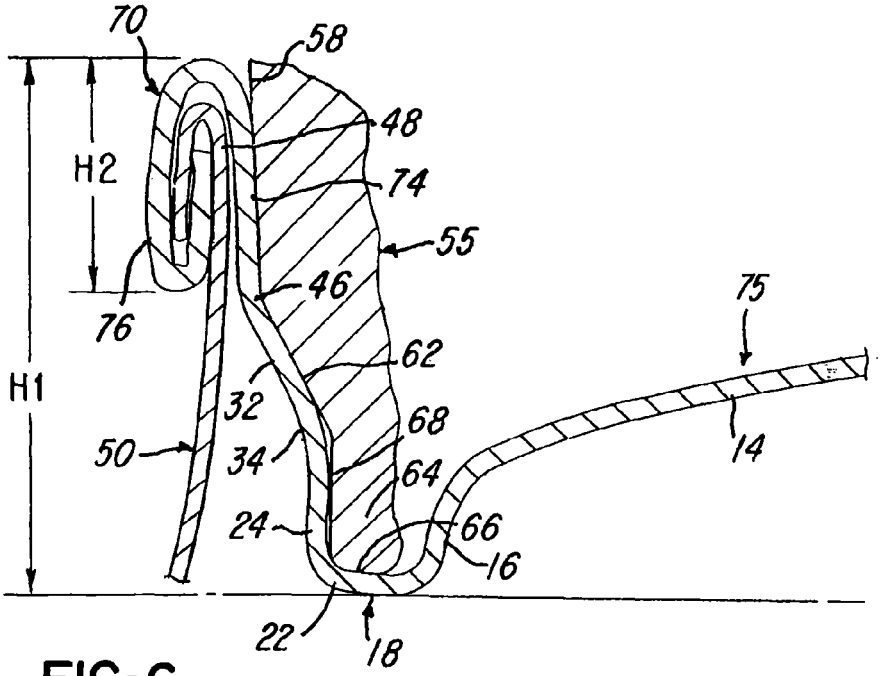
FIG. 5 is an enlarged fragmentary section of the double-seamed can end shown in FIG. 4 and with a fragment of the modified double-seaming chuck.

FIGS. 4 & 5 illustrates the completion of the double-seaming operation to form a double-seamed crown 70 between the rotating chuck 55 and a second stage double-seaming roller 72 which also moves radially inwardly while the chuck 55, shell 10 and can body 50 are spinning to convert the shell 10 into a can end 75 which is positively attached and sealed to the upper end portion 48 of the can body 50. The double-seamed rim or crown 70 has an inner wall 74 which is formed from the inner wall 38 of the shell crown 42 and also has an outer wall 76 formed from the shell crown 42 including the outer curled wall 44. The double-seamed crown 70 has a height H2 within the range between 0.090 inch and 0.110 inch and preferably about 0.100 inch. The can end 75 has an overall height H1 between the top of the crown 70 and the bottom of the countersink 18 within the range of 0.170 inch and 0.240 inch, and preferably about 0.235 inch. Since the can end 75 has the same cross-sectional configuration as the shell 10 with the exception of the double-seamed crown 70, the same common reference numbers are used in FIGS. 4-6 for the common structure.

Figure 6:
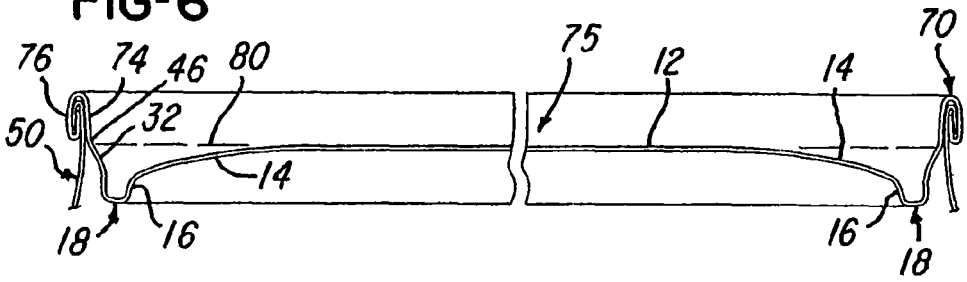
FIG. 6 is a section similar to FIG. 1 and showing a double-seamed can end formed in accordance with the invention.

As apparent from FIG. 6, the center portion of the center panel 12 defines a plane 80 which substantially intersects the junction 46 of the chuckwall 32 with the inner wall 74 of the double-seamed crown 70. The E-Z open tab has been omitted from FIG. 6 for purposes of clarity and simplification and since the E-Z open tab forms no part of the present invention.

Figure 7:
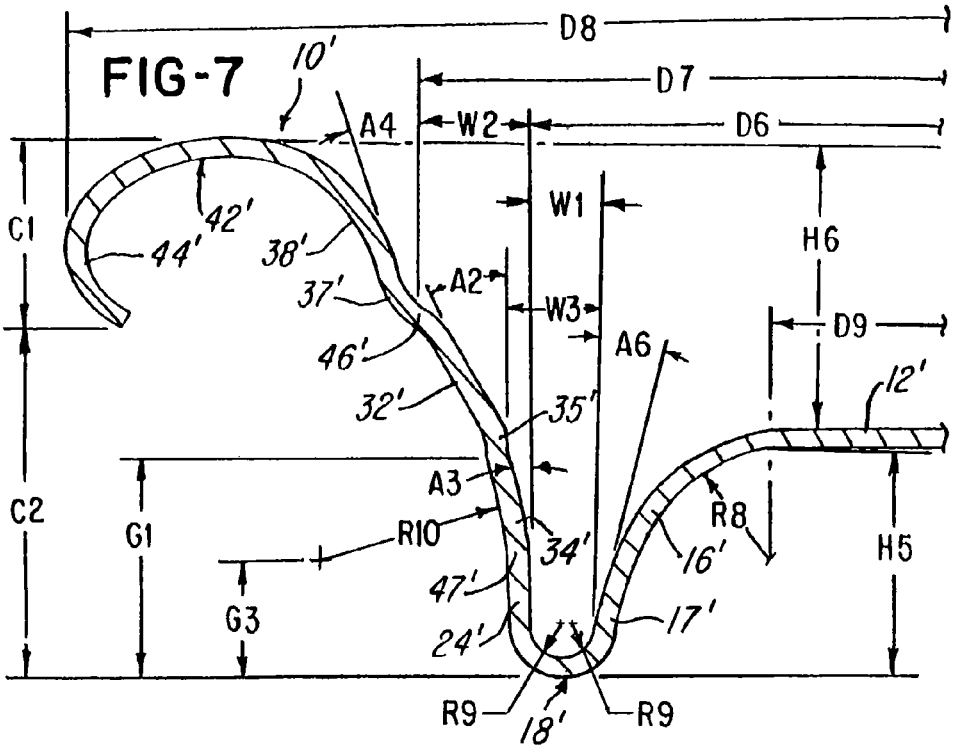
FIG. 7 is an enlarged fragmentary section similar to FIG. 2 and showing a can shell formed in accordance with a modification of the invention.
Figure 8:
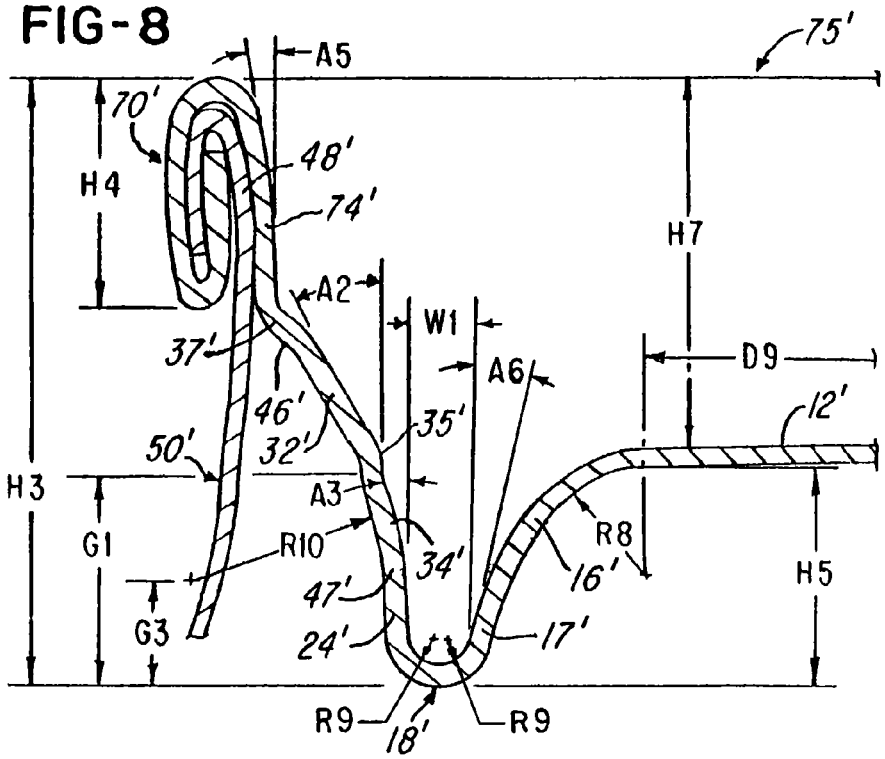
FIG. 8 is an enlarged fragmentary section similar to FIG. 5 and showing the can shell of FIG. 7 double-seamed onto a can body.

FIGS. 7 & 8 show another embodiment or modification of the invention including a can shell (FIG. 7) and a double-seamed can end (FIG. 8). Accordingly, the structural components corresponding to the components described above in connection with FIGS. 1-6, have the same reference numbers but with the addition of prime marks. Thus referring to FIG. 7, a can shell 10' has a center axis which is the same as the axis 11 and includes a circular center panel 12' connected to a peripheral curved panel wall 16' which connects with an inclined inner wall 17' of a countersink 18' having a U-shaped cross-sectional configuration. The countersink has a generally cylindrical outer wall 24' which extends at an angle less than 10° and connects with a chuckwall having a frusto-conical upper wall portion 32' and a slightly curved lower wall portion 34'. The wall portions 32' and 34' are connected by a kick or generally vertical short riser portion 35' having relatively sharp inside and outside radii, for example, on the order of 0.020 inch. The upper chuckwall portion 32' is connected by a curved wall 37' to the inner curved wall 38' of a crown 42' having a curved outer wall 44'.

The inner wall 38' of the crown 42' connects with the upper chuckwall portion 32' at a junction 46', and the outer wall 24' of the countersink 18' connects with the lower chuckwall portion 34' at a junction 47'. The vertical height G1 from the bottom of the countersink 18' to the kick or riser portion 35' is about 0.086. The radius R10 is about 0.051 inch, and the lower wall portion 34' extends at an angle A3 of about 15°. The countersink 18' has a radius R9 of about 0.009 to 0.011 inch. Other approximate dimensions and angles for the shell 10' shown in FIG. 7 are as follows:

| | | | | | |
|---|---|---|---|---|---|
| C1 | .082 inch | W1 | .024 inch | | |
| C2 | .153 inch | W2 | .063 inch | H5 | .078 inch |
| D6 | 1.910 inch | W3 | .034 inch | H6 | .149 inch |
| D7 | 2.036 inch | A2 | .29° | | |
| D8 | 2.337 inch | A3 | 15° | | |
| D9 | 1.731 inch | A4 | 16° | | |
| | | A6 | 13° | | |

The particular cross-sectional configuration of the can shell 10' has been found to provide performance results superior to the performance results provided by the can shell 10. Accordingly, the details of the configuration of the can shell 10' include a chuckwall upper wall portion 32' having an angle A2 relative to the center axis of at least 16° and preferably within the range of 25° to 30°. The lower wall portion 34' of the chuckwall forms an angle A3 which is about 15°. The inner wall 38' of the crown 42 forms an angle A4 preferably within the range of 5° to 30° and preferably about 16°. The inner wall 17' of the countersink 18' forms an angle A6 which is greater than 10° and about 13°. The width W1 of the countersink at the bottom between the inner wall 17' and the outer wall 24' is less than 0.040 inch and preferably about 0.024 inch. The radius R8 of the curved inner panel wall 16' is substantially greater than the width W1 of the countersink 18' and is about 0.049 inch.

The crown 42' of the shell 10' has a height C1 within the range of 0.075 inch to 0.095 inch and preferably about 0.082 inch and a height C2 within the range of 0.120 inch and 0.170 inch and preferably about 0.153 inch. The overall diameter D8 of the shell 10' is about 2.337 inch, and the diameter D7 to the junction 46' is about 2.036 inch. The inner bottom diameter D6 of the outer countersink wall 24' is about 1.910 inch, and the difference W2 between D7 and D6 is greater than the countersink width W1, or about 0.063 inch. The diameter D9 for the center of the radius R8 is about 1.731 inch. It is understood that if a different diameter shell is desired, the diameters D6-D9 vary proportionately. The height H5 of the center panel 12' above the bottom of the countersink 18' is within the range of 0.070 inch and 0.110 inch and preferably about 0.078 inch. The height H6 of the shell 10' between the top of the center panel 12' and the top of the crown 42', is within the range of 0.125 inch and 0.185 inch, and preferably about 0.149 inch.

Referring to FIG. 8, the shell 10' is double-seamed with the upper end portion 48' of a formed can body 50' using tooling substantially the same as described above in connection with FIGS. 3-5 to form a can end 75'. That is, a seamer chuck (not shown), similar to the chuck 55, includes a lower portion similar to the portion 64 which projects into the countersink 18' and has surfaces corresponding to the surfaces 58, 62 and 68 of the seamer chuck 55 for engaging the outer countersink wall 24', the chuckwall portion 32', and for forming the inner wall 74' of the double-seamed crown 70'. As also shown in FIG. 8, the inner wall 74' of the double-seamed crown 70' extends at a slight angle A5 of about 4°, and the overall height H3 of the can end 75' is less than 0.240 inch and preferably about 0.235 inch. The height H4 of the double-seamed crown 70' is on the order of 0.100 inch and the height H7 from the top of the crown 70' to the top of the center panel 12' is greater than the center panel height H5, preferably about 0.148 inch.

Figure 9:
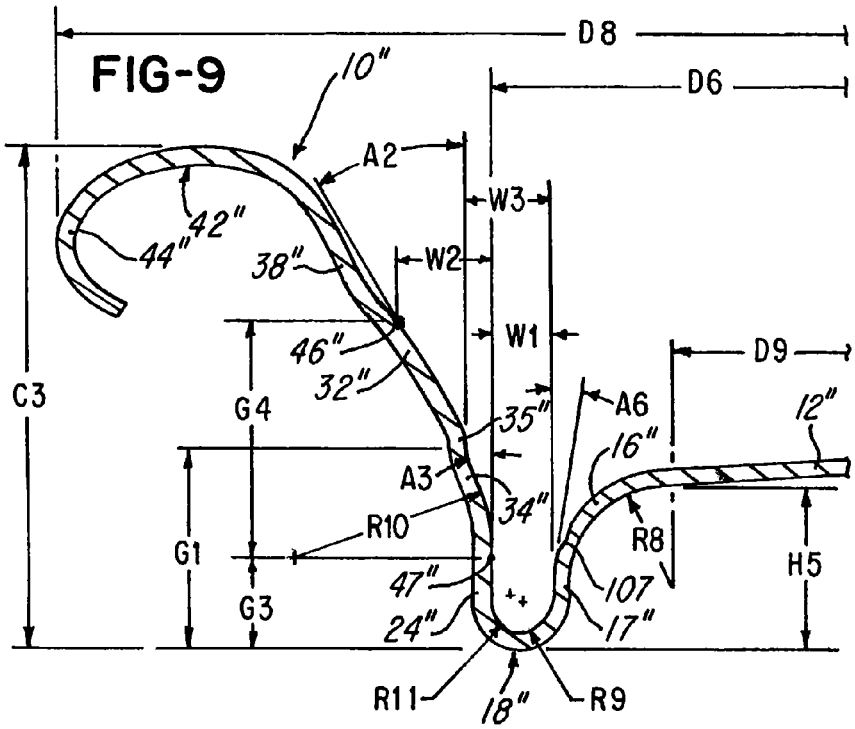
FIG. 9 is an enlarged fragmentary section similar to FIG. 7 and showing a can shell formed in accordance with another modification of the invention.
Figure 10:
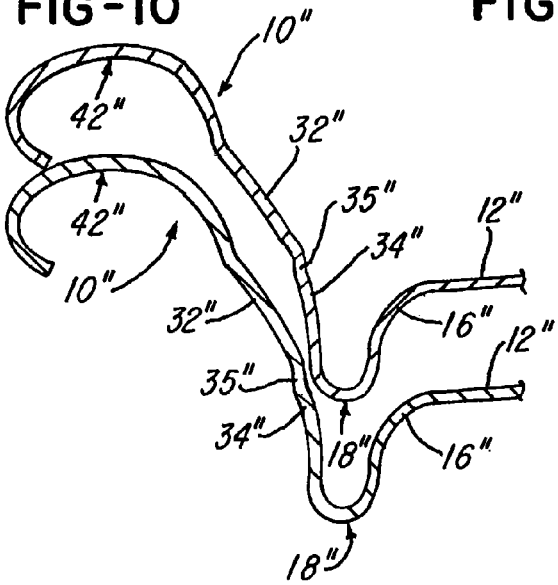
FIG. 10 illustrates the stacking and nesting of can shells formed as shown in FIG. 9.
Figure 11:
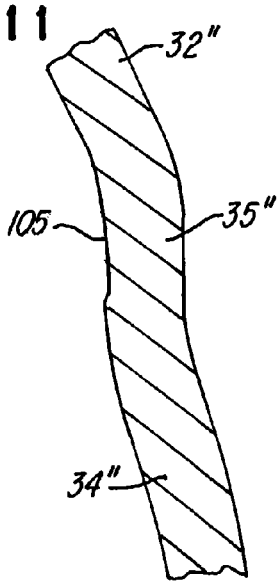
FIG. 11 is an enlarged fragmentary section of the chuckwall of the can shell shown in FIG. 9.

FIGS. 9-11 show another embodiment or modification of the invention including a can shell (FIG. 9) wherein the structural components corresponding to the components described above in connection with FIGS. 7 & 8 have the same reference numbers but with the addition of double prime marks. Thus referring to FIG. 9, a can shell 10" has a center axis which is the same as the axis 11 and includes a circular center panel 12" connected to a peripheral curved panel wall 16" which connects with an inclined inner wall 17" of a countersink 18" having a U-shaped cross-sectional configuration. The countersink has a generally cylindrical outer wall 24" which extends at an angle less than 10° and connects with a chuckwall having a frusto-conical upper wall portion 32" and slightly curved lower wall portion 34".

The wall portions 32" and 34" are connected by a kick or generally vertical or generally cylindrical short riser wall portion 35" having relatively sharp inside and outside radii, for example, on the order of 0.020 inch. The upper chuckwall portion 32" is connected to an inner wall 38" of a crown 42" having a curved outer wall 44". As shown in FIG. 11, the riser wall portion 35" has a coined outer surface 105 which results in the wall portion 35" having a thickness slightly less than the wall thickness of the adjacent wall portions 32" and 34".

The inner wall 38" of the crown 42" connects with the upper chuckwall portion 32" at a junction 46", and the outer wall 24" of the countersink 18" connects with the lower chuckwall portion 34" at a junction 47". The vertical height G1 from the bottom of the countersink 18" to the kick or riser wall portion 35" is about 0.099. The radius R10 is about 0.100 inch, and the lower wall portion 34" extends at an angle A3 of about 15°. The countersink 18" has an inner radius R9 of about 0.021 inch and an outer radius R11 of about 0.016 inch. Other approximate dimensions and angles for the shell 10" shown in FIG. 9 are as follows:

| | | | | | |
|---|---|---|---|---|---|
| C3 | .249 inch | W1 | .030 inch | G3 | .045 inch |
| D6 | 1.900 inch | W2 | .047 inch | G4 | .117 inch |
| D8 | 2.336 inch | W3 | .043 inch | H5 | .081 inch |
| D9 | 1.722 inch | A2 | .29° | R8 | .051 inch |
| | | A6 | .8° | | |

The particular cross-sectional configuration of the can shell 10" has been found to provide performance results somewhat superior to the performance results provided by the can shell 10'. Accordingly, the details of the configuration of the can shell 10" include a chuckwall upper wall portion 32" having an angle A2 relative to the center axis of at least 16° and preferably within the range of 25° to 30°. The lower wall portion 34" of the chuckwall forms an angle A3 which is about 15°. The inner wall 17" of the countersink 18" forms and angle A6 which is less than 10° and about 8°. The width W1 of the countersink at the bottom between the inner wall 17" and the outer wall 24" is less than 0.040 inch and preferably about 0.030 inch. The radius R8 of the curved inner panel wall 16" is substantially greater than the width W1 of the countersink 18" and is about 0.051 inch.

The crown 42" of the shell 10" has a height C3 from the bottom of the countersink 18" of about 0.249 inch. The overall diameter D8 of the shell 10" is about 2.336 inch. The inner bottom diameter D6 of the outer countersink wall 24" is about 1.900 inch, and the difference in diameter W2 is greater than the countersink width W1, or about 0.047 inch. The diameter D9 for the center of the radius R8 is about 1.722 inch. It is understood that if a different diameter shell is desired, the diameters D6, D8 & D9 vary proportionately. The height H5 of the center panel 12" above the bottom of the countersink 18" is preferably about 0.081 inch. As shown in FIG. 9, the curved panel wall 16" has a coined portion 107 with a thickness less than the thickness of the adjacent portions of the panel wall 16".

Figure 12:
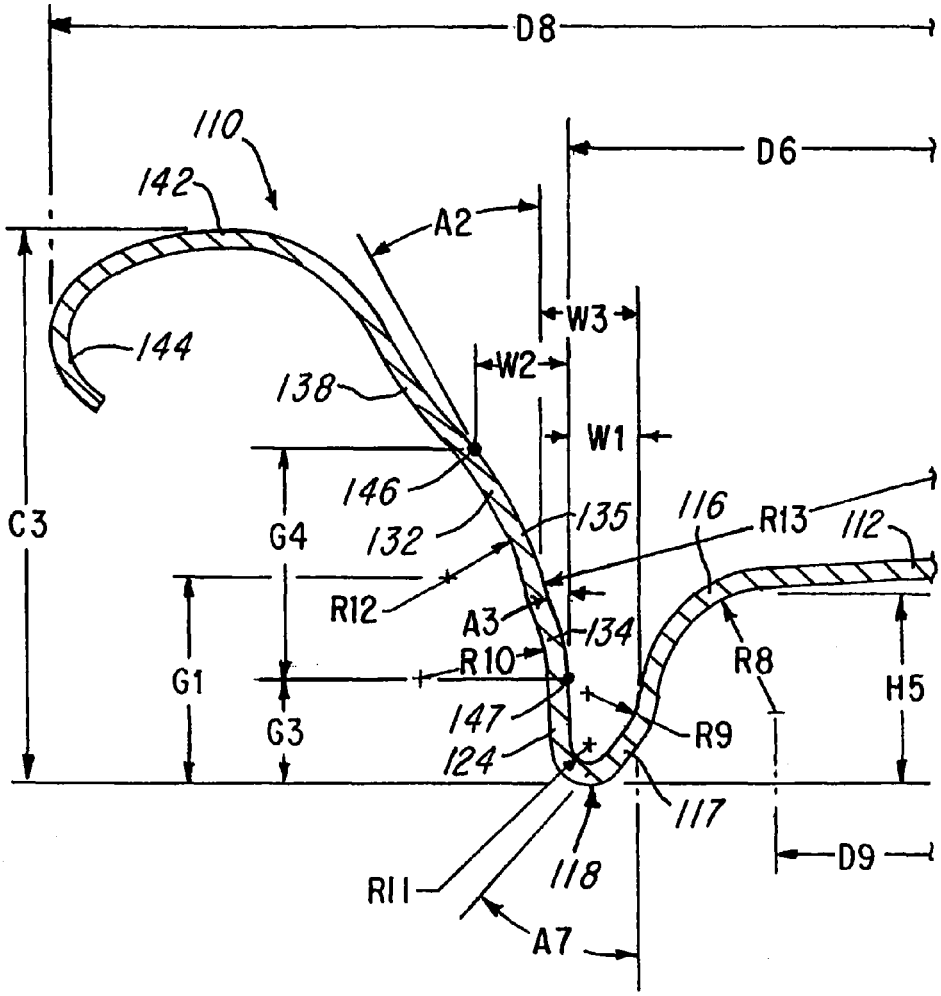
FIG. 12 is an enlarged fragmentary section similar to FIG. 9 and showing a can shell formed in accordance with another modification of the invention.

FIG. 12 shows another embodiment or modification of the invention and wherein a can shell 110 has structural components corresponding to the components described above in connection with FIGS. 7-9 and having the same reference numbers as used in FIG. 9 but with the addition of "100". Thus referring to FIG. 12, the can shell 110 has a center axis which is the same as the axis 11 and includes a center panel 112 connected to a peripherally extending curved panel wall 116 having a radius between about 0.040 and 0.060 inch. The panel wall 116 forms a curved bevel and connects with an inclined inner wall 117 of a countersink 118 having a U-shaped cross sectional configuration. The inner wall 117 extends at an angle A7 of at least about 30°, and the countersink has an outer wall 124 which extends at an angle between 3° and 19° and connects with an inclined chuckwall having a generally frusto-conical upper wall portion 132 and a slightly curved lower wall portion 134.

The wall portions 132 and 134 are integrally connected by a curved portion 135 resulting in an angular break or a slightly reverse curve configuration formed by radii R10, R12 and R13. The upper chuckwall portion 132 is connected to an inner wall portion 138 of a crown 142 having a curved outer wall 144. The inner wall 138 of the crown 142 connects with the upper chuckwall portion 132 at a first junction 146, and the outer wall portion 124 of the countersink 118 connects with the lower chuckwall portion 134 at a second junction 147.

The approximate preferred dimensions and angles for the shell 110 shown in FIG. 12 are as follows:

| | | | | | | | |
|---|---|---|---|---|---|---|---|
| C3 | .246 inch | W1 | .030 inch | R8 | .050 | G1 | .091 inch |
| D6 | 1.895 " | W2 | .042 " | R9 | .022 | G3 | .047 " |
| D8 | 2.335 " | W3 | .043 " | R10 | .054 | G4 | .101 " |
| D9 | 1.718 " | A2 | 29° | R11 | .009 | H5 | .082 " |
| | | A3 | 15° | R12 | .031 | | |
| | | A7 | 42° | R13 | .190 | | |

The cross-sectional configuration of the can shell 110 having the above dimensions and angles has been found to provide performance results slightly superior to the performance results provided by the can shell 10' and 10". The added benefits of the angular or inclined inner countersink wall 117 is set forth in above mentioned U.S. Pat. No. 5,685,189, the disclosure of which is incorporated by reference. In addition, the combination of the beveled panel wall 116 and the inclined inner countersink wall 117 provide for increased buckle strength. Also, the above statements and advantages of the can shell 10' and 10" also apply to the can shell 110 shown in FIG. 12.

Figure 13:
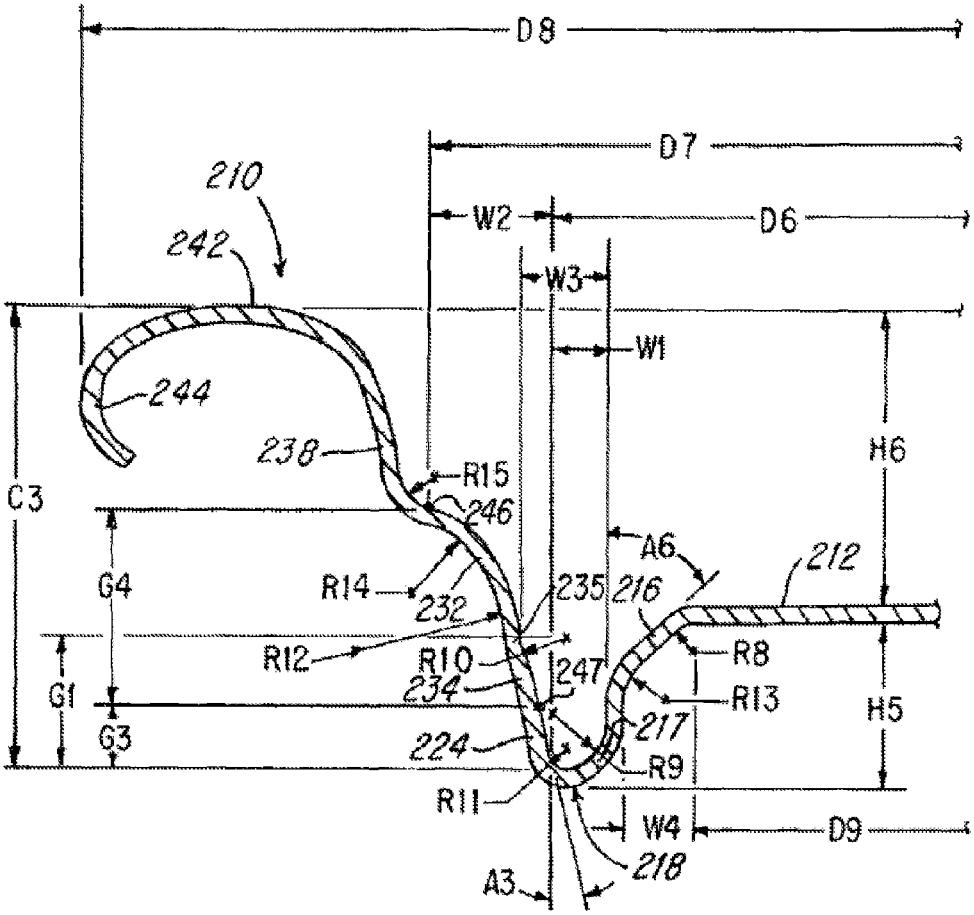
FIG. 13 is an enlarged fragmentary section similar to FIG. 12 and showing a can shell formed in accordance with a further modification of the invention.

FIG. 13 shows another embodiment or modification of the invention and wherein a can shell 210 has structural components corresponding to the components described above in connection with FIGS. 7-9 and 12 and having the same reference numbers as used in FIGS. 9 & 12, but with the addition of "200". Thus referring to FIG. 13, the can shell 210 has a vertical center axis which is the same as the axis 11 and includes a circular center panel 212 connected to an inclined or beveled panel wall 216. As shown in FIG. 13, the inclined or beveled panel wall 216 has straight inner and outer surfaces and extends at an acute angle A6 which is within the range of 30° to 60° and connects through a vertical wall with an inclined inner wall 217 of a countersink 218 formed by radii R9 and R11 and having a generally U-shaped cross sectional configuration. The countersink 218 has an inclined outer wall 224 and connects with a chuckwall having an inclined or curved upper wall portion 232 formed by radii R12 and R14 and an inclined lower wall portion 234. The outer wall 224 of the countersink 218 and the lower wall portion 234 of the chuckwall extend at an angle A3 which is within the range of 3° to 19°.

The chuckwall portions 232 and 234 are integrally connected by a short wall portion 235 forming a kick or break between the upper and lower chuckwall portions 232 and 234 and formed by radius R10. The upper chuckwall portion 232 is connected to an inner wall portion 238 of a crown 242 having a curved outer wall 244. The inner wall 238 of the crown 242 extends at an angle less than 16° and connects by a radius R15 with the upper chuckwall portion 232 at a junction 246. As apparent from FIG. 13, this angle of the inner wall 238 is less than the angle of the inclined or curved upper chuckwall portion 232 formed by a straight line connecting its end points at the junction 246 and break forming wall portion 235. The outer wall portion 224 of the countersink 218 connects with the lower chuckwall portion 234 at a junction 247.

The approximate and preferred dimensions and angles for the shell 210 shown in FIG. 13 are as follows:

| | | | | | | | |
|---|---|---|---|---|---|---|---|
| C3 | .235 inch | W1 | .029 inch | R8 | .014 | R14 | .035 inch |
| D6 | 1.873 " | W2 | .068 " | R9 | .029 | R15 | .018 " |
| D7 | 2.008 " | W3 | .044 " | R10 | .022 | G1 | .068 " |
| D8 | 2.337 " | W4 | .036 | R11 | .009 | G3 | .031 " |
| D9 | 1.728 " | A3 | 14° | R12 | .077 | G4 | .102 " |
| | | A6 | 45° | R13 | .021 | H5 | .084 " |
| | | | | | | i. H6 | .151 " |

The cross-sectional configuration of the can shell 210 having the above approximate dimensions and angles has been found to provide performance results somewhat superior to the performance results provided by the can shells 10', 10" and 110. The inclined or beveled panel wall 216 cooperates with the inclined inner wall 217 of the countersink 218 and the relative small radius R11 to increase buckle strength, and the inclined walls 224 and 234 and break-forming wall portion 235 cooperate to increase strength and prevent leaking during a drop test.

The curved panel wall 116 (FIG. 12) or the linear wall 216 (FIG. 13) may also be formed with short linear wall sections in axial cross-section thereby providing a faceted inclined annular panel wall. In addition, the above statements and advantages of the can shell 10', 10" and 110 also apply to the can shell 210 shown in FIG. 13.

By forming a shell and can end with the profile or configuration and dimension described above, and especially the profile of the bevel panel wall 216, countersink 218 and wall portion 234 shown in FIG. 13, it has been found that the seamed can end may be formed from aluminum sheet having a thickness of about 0.0082 inch, and the seamed can end will withstand a pressure within the can of over 110 psi before the can end will buckle. The configuration and relative shallow profile of the can shell also result in a seamed can end having an overall height of less than 0.240 inch, thus providing for a significant reduction of over 0.040 inch in the diameter of the circular blank which is used to form the shell. This reduction in diameter results in a significant reduction in the width of aluminum sheet or web used to produce the shells, thus a reduction in the weight and cost of aluminum to form can ends, which is especially important in view of the large volume of can ends produced each year.

The shell of the invention also minimizes the modifications required in the tooling existing in the field for forming the double-seamed crown 70 or 70' or for double-seaming the crown 42" or 142 or 242. That is, the only required modification in the tooling for forming the double-seamed crown is the replacement of a conventional or standard double-seaming chuck with a new chuck having the frusto-conical or mating surface 62 (FIG. 5) and the mating surface 68 on the bottom chuck portion 64 which extends into the countersink and engages the outer countersink wall. Conventional double-seaming chucks commonly have the slightly tapered surface 58 which extends at an angle of about 4° with respect to the center axis of the double-seaming chuck. As also shown in FIG. 10, the slight break or S-curve configuration of the intermediate portion 35" or 135 or 235 of the chuckwall of the shell provides for stacking the shells in closely nested relation in addition to increasing the buckle strength of the can end formed from the shell.

As appreciated by one skilled in the art, the end closures or shells described herein in FIGS. 1-11 may generally be manufactured using end closure forming tools commonly known in the art. With respect to FIGS. 12 and 13 and the end closure or shell geometry or profiles disclosed in reference thereto, it is believed that numerous advantages in the manufacturing process and formed end closure can be realized using an improved process and apparatus as described in pending U.S. Provisional Patent Application filed on Jul. 29, 2004 and entitled "Method and Apparatus for Shaping a Metallic End Closure" which is incorporated herein by reference in its entirety.

While the forms of can shell and can end herein described and the method of forming the shell and can end constitute preferred embodiments of the invention, it is to be understood that the invention is not limited to these precise forms of can shell and can end, and that changes may be made therein without departing from the scope and spirit of the invention as defined in the appended claims.

What is claimed is:

1. A one-piece metallic end closure adapted for double seaming to a container, comprising:

a peripheral curl having a first end and a second end, said first end adapted for interconnection to a neck of the container;

a horizontal circular center panel with a vertical center axis;

an inclined linear panel wall with a substantially uniform thickness interconnected on an upper end to said horizontal circular center panel at a first radius of curvature, said inclined linear panel wall having an angle between 30° and 60° relative to said center axis;

a countersink comprising an inner wall portion, an outer wall portion, and a generally U-shaped cross-sectional configuration, said inner wall portion interconnected to said inclined linear panel wall at a second radius of curvature; and a chuck wall comprising an inclined lower wall portion interconnected to said countersink outer wall portion, and an upper wall portion interconnected to said second end of said peripheral curl at a junction, said junction formed from a third radius of curvature and a fourth radius of curvature oriented in opposite directions and positioned above a lowermost portion of said countersink a distance of at least about 0.133 inches.

2. The end closure of claim 1, wherein said first radius of curvature is about 0.014 inches.

3. The end closure of claim 1, wherein said second radius of curvature is about 0.021 inches.

4. The end closure of claim 1, wherein said third radius of curvature is about 0.035 inches.

5. The end closure of claim 1, wherein said fourth radius of curvature is about 0.018 inches.

6. The end closure of claim 1, wherein the distance between said peripheral curl and said lowermost portion of said countersink is about 0.235 inches.

7. The end closure of claim 1, wherein said junction is positioned about 0.102 inches below an uppermost portion of said peripheral curl prior to double seaming.

8. The end closure of claim 1, wherein said horizontal circular center panel is raised above said lowermost portion of said countersink a distance of about 0.084 inches.

9. The end closure of claim 1, wherein the generally U-shaped cross-sectional configuration of said countersink is formed by a first countersink radius of curvature of about 0.029 inches and a second countersink radius of curvature of about 0.009 inches.

10. The end closure of claim 1, wherein said center panel is 0.016 inches above said break forming wall portion of said chuck wall.

11. A one piece metallic end closure adapted for double seaming to a neck of a container, comprising:

a substantially circular center panel with a vertical center axis;

a peripheral curl having a first end and a second end, said first end adapted for interconnection to the neck of the container;

a countersink having an outer panel wall and an inner panel wall;

an inclined, substantially linear panel wall interconnected on an upper end to said substantially circular center panel at a first radius of curvature and interconnected on a lower end to an upper end of said countersink inner panel wall, said inclined, substantially linear panel wall oriented at an angle between about 30 and 60 degrees with respect to said vertical axis and having a substantially uniform thickness, said countersink further defined by a second radius of curvature below said inner panel wall and a third radius of curvature below said outer panel wall, and wherein said inclined, substantially linear panel wall when viewed in cross-section is substantially linear; and a chuck wall comprising an upper wall portion interconnected to said second end of said peripheral curl and a lower wall portion extending inwardly and downwardly, said upper chuck wall portion interconnected to said lower chuck wall portion by a break forming wall portion at a fourth radius of curvature, said countersink outer panel wall interconnected to said lower wall portion of said chuck wall, and said center panel elevated above said break forming wall portion of said chuck wall;

wherein said first radius of curvature is about 0.014 inches.

12. The end closure of claim 11, wherein said second radius of curvature is about 0.029 inches and said third radius of curvature is about 0.009 inches.

13. The end closure of claim 11, wherein said fourth radius of curvature is about 0.022 inches.

14. A one piece metallic end closure adapted for double seaming to a neck of a container, comprising:

a peripheral curl having a first end and a second end, said first end adapted for interconnection to the neck of the container;

a chuck wall comprising an upper wall portion interconnected to said second end of said peripheral curl through a junction with a chuck wall transition radius of curvature and a lower wall portion extending inwardly and interconnected to said upper chuck wall portion by a nonlinear break forming wall portion;

a countersink having an outer panel wall interconnected to said lower wall portion of said chuck wall, and an inner panel wall extending upwardly, said inner panel wall having an upper end with a substantially vertically extending portion; and an inclined, substantially linear panel wall as viewed in vertical cross-section, which is interconnected on an upper end at a first radius of curvature to a substantially circular horizontal center panel with a vertical center axis and interconnected on a lower end at a second curve with a second radius of curvature to said substantially vertically extending portion of said upper end of said countersink inner panel wall, said inclined, substantially linear panel wall having a substantially uniform thickness between said first curve and said second curve, said countersink further defined by a third curve with a third radius of curvature below said inner panel wall and a fourth curve with a fourth radius of curvature below said outer panel wall, and said nonlinear break forming wall portion having a fifth radius of curvature.

15. The end closure of claim 14, wherein said chuck wall transition radius of curvature is about 0.018 inches.

16. The end closure of claim 14, wherein said first radius of curvature is about 0.014 inches and said second radius of curvature is about 0.021 inches.

17. The end closure of claim 14, wherein said third radius of curvature is about 0.029 inches and said fourth radius of curvature is about 0.009 inches.

18. The end closure of claim 14, wherein said fifth radius of curvature is about 0.022 inches.

19. The end closure of claim 14, wherein said break forming wall portion is 0.068 inches above a lowermost portion of said countersink.

* * * * *